US011397003B2

(12) United States Patent
Sei

(10) Patent No.: US 11,397,003 B2
(45) Date of Patent: Jul. 26, 2022

(54) PREMIXING APPARATUS, HEAT SOURCE APPARATUS, AND WATER HEATER

(71) Applicant: PURPOSE CO., LTD., Fuji (JP)

(72) Inventor: Tsuyoshi Sei, Fuji (JP)

(73) Assignee: PURPOSE CO., LTD., Fuji (JP)

( * ) Notice: Subject to any disclaimer, the term of this patent is extended or adjusted under 35 U.S.C. 154(b) by 255 days.

(21) Appl. No.: 16/747,851

(22) Filed: Jan. 21, 2020

(65) Prior Publication Data

US 2020/0158332 A1 May 21, 2020

Related U.S. Application Data

(63) Continuation of application No. 15/848,935, filed on Dec. 20, 2017, now Pat. No. 10,655,848.

(30) Foreign Application Priority Data

Feb. 16, 2017 (JP) ..... JP2017-026779

(51) Int. Cl.

| | |
|---|---|
| ***F23D 14/62*** | (2006.01) |
| ***F23D 14/02*** | (2006.01) |
| ***F23N 1/02*** | (2006.01) |
| ***F23K 5/14*** | (2006.01) |
| ***F23D 14/34*** | (2006.01) |

(52) U.S. Cl.

CPC ..... *F23D 14/62* (2013.01); *F23D 14/02* (2013.01); *F23D 14/34* (2013.01); *F23K 5/147* (2013.01); *F23N 1/02* (2013.01); *F23N 1/022* (2013.01); *F23D 2203/007* (2013.01); *F23D 2900/00003* (2013.01); *F23N 2235/18* (2020.01); *F23N 2235/20* (2020.01)

(58) Field of Classification Search

None

See application file for complete search history.

(56) References Cited

U.S. PATENT DOCUMENTS

| | | | | |
|---|---|---|---|---|
| 2007/0006865 | A1* | 1/2007 | Wiker | F24C 3/122 126/21 A |
| 2011/0168284 | A1 | 7/2011 | Whitford et al. | |
| 2013/0220301 | A1 | 8/2013 | Saksena et al. | |

(Continued)

FOREIGN PATENT DOCUMENTS

| | | |
|---|---|---|
| JP | S51-031844 U | 3/1976 |
| JP | 2001-173949 A | 6/2001 |

(Continued)

OTHER PUBLICATIONS

"What is an Electronic Controller", http://www.cpinc.com/trerice/Control/control_43_44.pdf (Year: 2006).*

(Continued)

*Primary Examiner* — Jason Lau

(74) *Attorney, Agent, or Firm* — WHDA, LLP

(57) ABSTRACT

A premixing apparatus includes a mixing unit, an air supply adjusting unit, and a gas switching unit. The mixing unit draws a fuel gas in the mixing unit by supplied air to mix the fuel gas and the supplied air with each other. The air supply adjusting unit applies a load on the supplied air flowing toward the mixing unit and switches the load. The gas switching unit switches a gas amount of the fuel gas to be supplied to the mixing unit.

7 Claims, 13 Drawing Sheets

(56) References Cited

U.S. PATENT DOCUMENTS

| | | | | |
|---|---|---|---|---|
| 2015/0086931 | A1 | 3/2015 | Kim et al. | |
| 2015/0354810 | A1* | 12/2015 | Nakatani | F23D 14/34 431/354 |
| 2016/0298838 | A1* | 10/2016 | Karkow | F23N 5/006 |

FOREIGN PATENT DOCUMENTS

| | | | |
|---|---|---|---|
| JP | 2001-201045 | A | 7/2001 |
| JP | 2008-281271 | A | 11/2008 |
| JP | 2014-215007 | A | 11/2014 |
| JP | 2015-519532 | A | 7/2015 |
| JP | 2015-230113 | A | 12/2015 |
| WO | 2016/181212 | A1 | 11/2016 |

OTHER PUBLICATIONS

Office Action dated Jun. 9, 2020, issued in counterpart JP application No. 2017-026779, with English translation. (6 pages).
Office Action dated Jul. 11, 2019, issued in counterpart U.S. Appl. No. 15/848,935.
Office Action dated Oct. 11, 2019, issued in counterpart U.S. Appl. No. 15/848,935.

* cited by examiner

PREMIXING APPARATUS, HEAT SOURCE APPARATUS, AND WATER HEATER

CROSS-REFERENCE TO RELATED APPLICATIONS

This is a continuation application of application Ser. No. 15/848,935, filed Dec. 20, 2017, which is entitled to the benefit of priority of Japanese Patent Application No. 2017-026779, filed on Feb. 16, 2017, the contents of which are hereby incorporated by reference.

BACKGROUND OF THE INVENTION i) Field of the Invention

The present disclosure relates to a technique of premixing an air-fuel mixture formed from a fuel gas, a technique for a heat source by combustion of the air-fuel mixture, and a technique of supplying hot water using the heat source.

ii) Description of the Related Art

In a heat source apparatus using combustion heat of a fuel gas as its heat source, a gas burner combusting the fuel gas is used. A metal knit burner including a metal knit in the combustion plane of the burner is used as this gas burner, and a premixing apparatus is used in each of the metal knit burner and a burner similar to this. The premixing apparatus mixes the fuel gas and a gas such as air with each other to make an air-fuel mixture.

It is known that the premixing apparatus includes a switching means for the air resistance together with an air amount adjusting valve in an air supply path, and executes switching of the air resistance against the valve in accordance with the adjustment of the air amount (see, e.g., Japanese Laid-Open Patent Publication No. 2014-215007).

It is known that a combusting apparatus including a premixing apparatus includes a venturi structure to premix air and a gas, the inside of a premixing chamber is partitioned in multiple stages by the venturi structure to stabilize the combustion state in a load region at a low output by improving the turndown ratio of the burner to thereby cause the belching direction of the gas in the premixing chamber to be parallel to the flow direction of the air (see, e.g., Japanese Translation of PCT International Application Publication No. JP-T-2015-519532).

BRIEF SUMMARY OF THE INVENTION

A fan is used to supply air and a butterfly valve is provided for an air path of the premixing apparatus. The adjustment of the air supply amount is executed by both of the number of rotations of the fan and the butterfly valve, and the air supply amount can be adjusted across a range in which the air supply amount is adjusted by the number of rotations of the fan. The air amount can be adjusted in a range from the minimal number of rotations to the maximal number of rotations of the fan, and the opening and closing of the butterfly valve is added to the above adjustment of the air amount. The air amount adjustment is enabled with the air amount adjustment by the butterfly valve being capable of opening and closing in a range from the fully closing state to the fully opening state, in the range from the minimal number of rotations to the maximal number of rotations of the fan. The burner can thereby widely take the adjustment range of the combustion capacity from the minimal combustion to the maximal combustion. The turndown ratio of the burner can therefore widely be taken.

The number of rotations of a fan disposed together with a burner of a heater or a water heater is about 2,000 to about 6,000 [rpm]. The turndown ratio is therefore about 1:3. Assuming that the minimal gas consumption (66,300 [BTU/h]) is 1 when the turndown ratio is 1:3, the maximal gas consumption (199,000 [BTU/h]) is 3. The ratios of the minimal gas consumption to the maximal gas consumption are 1:3.

According to a first aspect of the present disclosure, a premixing apparatus includes a mixing unit that draws a fuel gas in the mixing unit by supplied air to mix the fuel gas and the supplied air with each other; an air supply adjusting unit that applies a load on the supplied air flowing toward the mixing unit to switch the load; and a gas switching unit that switches a gas amount of the fuel gas to be supplied to the mixing unit.

According to a second aspect of the present disclosure, a heat source apparatus includes the premixing apparatus; a combusting unit that combusts an air-fuel mixture formed by the premixing apparatus; and an air supply fan that supplies the air-fuel mixture from the premixing apparatus to the combusting unit.

According to a third aspect of the present disclosure, a water heater includes the heat source apparatus and a heat exchanging unit that heat-exchanges the heat of a combustion exhaust generated in the combusting unit of the heat source apparatus with supplied water to heat the supplied water.

DETAILED DESCRIPTION OF THE INVENTION

In the case where an air mount adjusting valve is provided for the air supply path, a load can be applied to the supplied air by the air amount adjusting valve and the air supply amount can be reduced from the air supply amount acquired when the number of rotations of the fan is the minimal value. The inventor acquired the knowledge that the turndown ratio can be expanded to 1:15 because the gas consumption becomes 13,000 to 199,000 [BTU/h] when the gas amount is adjusted together with the adjustment of the air supply amount. For this control, adjustment of the gas amount matched with the adjustment of the air supply amount may be necessary along with the concurrent control of the number of rotations of the fan and the load on the supplied air.

An object of the present disclosure is to enable the adjustment of the gas amount of the fuel gas matched with the adjustment of the air supply amount along with the concurrent control of the number of rotations of the fan and the load on the supplied air.

Figure 1:
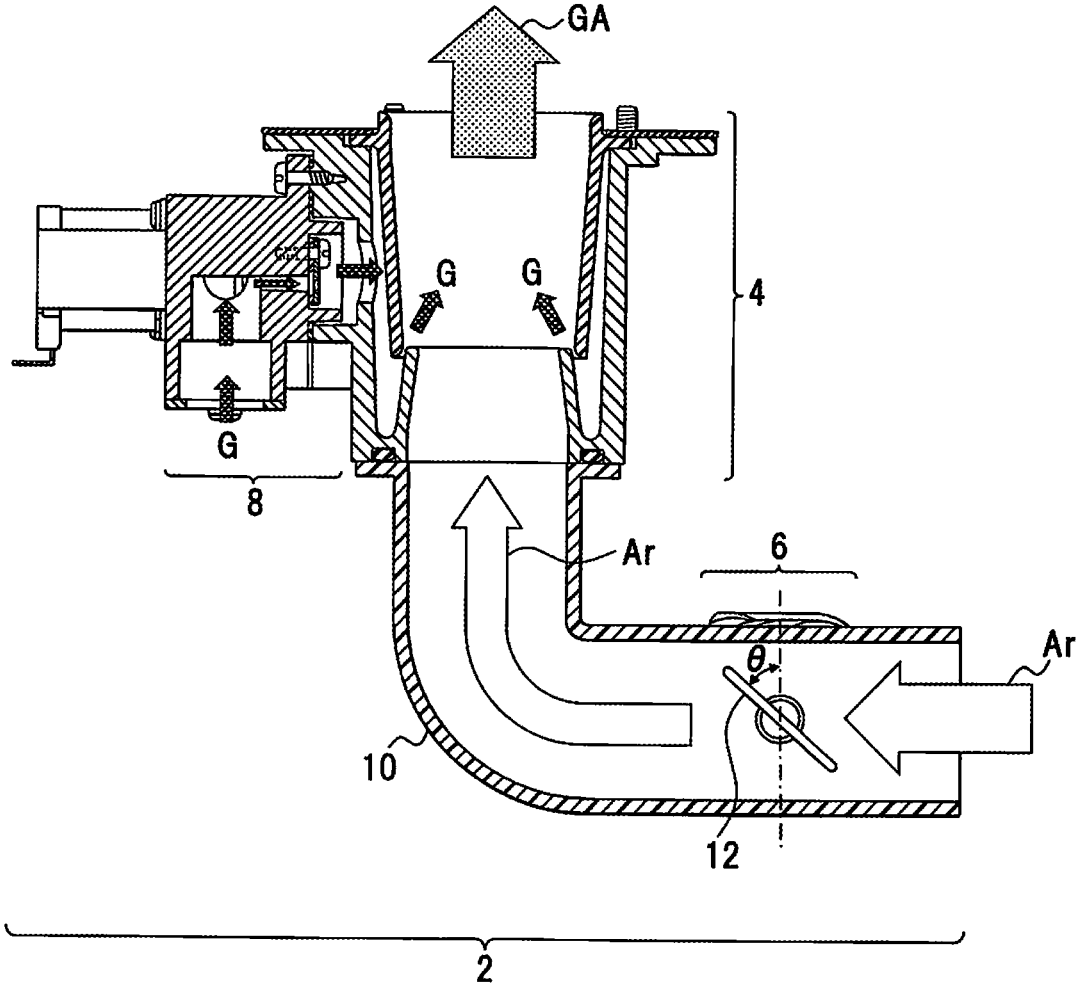
FIG. 1 is a diagram of a premixing apparatus according to an embodiment.

FIG. 1 depicts a premixing apparatus according to an embodiment. The configuration depicted in FIG. 1 is an example and the present disclosure is not limited to this configuration.

The premixing apparatus 2 includes a venturi unit 4, an air supply adjusting unit 6, and a gas switching unit 8. As an example, air Ar in the atmosphere is used as supplied air for the premixing apparatus 2 and the air Ar is supplied to the venturi unit 4 by the rotation of an air supply fan (an air supply fan 70 in FIG. 3).

The venturi unit 4 is an example of a mixing unit that mixes the air Ar and a fuel gas G with each other to form an air-fuel mixture GA. As to the venturi unit 4, the pressure in the venturi unit 4 becomes negative by the flow of the air Ar to draw the fuel gas G into the venturi unit 4. The fuel gas G drawn into the venturi unit 4 surrounds the overall circumference of the air Ar to thereafter be mixed with the air Ar.

The air supply adjusting unit 6 is disposed on an upstream side of the venturi unit 4 and applies stepwise different loads to the air Ar flowing toward the venturi unit 4 to adjust stepwise the amount of the air Ar flowing toward the venturi unit 4. In this example, a cylinder unit 10 is joined to the venturi unit 4 and an air adjusting valve 12 of the air supply adjusting unit 6 is disposed on the cylinder unit 10. The air supply adjusting unit 6 switches the valve angle θ of the air adjusting valve 12 among, for example, opening angles θ1, θ2, and θ3. The magnitude relation among the opening angles θ1, θ2, and θ3 is as follows: $\theta 1<\theta 2<\theta 3$. When the angle θ is, for example, the minimal opening angle (θ=θ1), the load on the air Ar is the maximal load. When the angle θ is, for example, the intermediate angle (θ=θ2), the load on the air Ar is an intermediate load. When the angle θ is, for example, the maximal angle (θ=θ3), the load on the air Ar is no load. In this manner, the amount of the air Ar flowing toward the venturi unit 4 can be adjusted in three stages by applying the loads in the three stages to the air Ar. The minimal opening angle θ1 may include an angle corresponding to a fully closed state.

For this air adjustment, the gas switching unit 8 adjusts the gas amount of the fuel gas G drawn into the venturi unit 4 in, for example, three stages. The adjustment of the gas amount of the fuel gas G can be combined with the three-stage adjustment of the air Ar as shown in the following a) to c):

a) At the opening angle θ1 of the air adjusting valve 12 of θ=θ1, the switching of the gas amount by the gas switching unit 8, b) At the opening angle θ2 of the air adjusting valve 12 of θ=θ2, the switching of the gas amount by the gas switching unit 8, and c) At the opening angle θ3 of the air adjusting valve 12 of θ=θ3, the switching of the gas amount by the gas switching unit 8.

The combustion amount of the air-fuel mixture GA of the fuel gas G can be adjusted in the range from the minimal combustion amount to the maximal combustion amount based on the combinations of the a) to the c).

Effects of Embodiment

According to this embodiment, the following effects are achieved.

(1) According to the premixing apparatus 2, the adjustment range of the combustion gas amount, that is, the width between the minimal combustion amount and the maximal combustion amount can widely be taken and the turndown ratio can be set to, for example, 1:15.

(2) The air supply adjusting unit 6 applies the loads stepwise or continuously to the air Ar and the air Ar flowing toward the venturi unit 4 can be adjusted stepwise or continuously.

(3) The adjustment of the amount of the air Ar is executed by the air supply adjusting unit 6 on the upstream side of the venturi unit 4 and the gas amount of the fuel gas G can separately be adjusted by the gas switching unit 8 and, as a result, both of the adjusting mechanisms can be simplified.

Example 1

Figure 2:
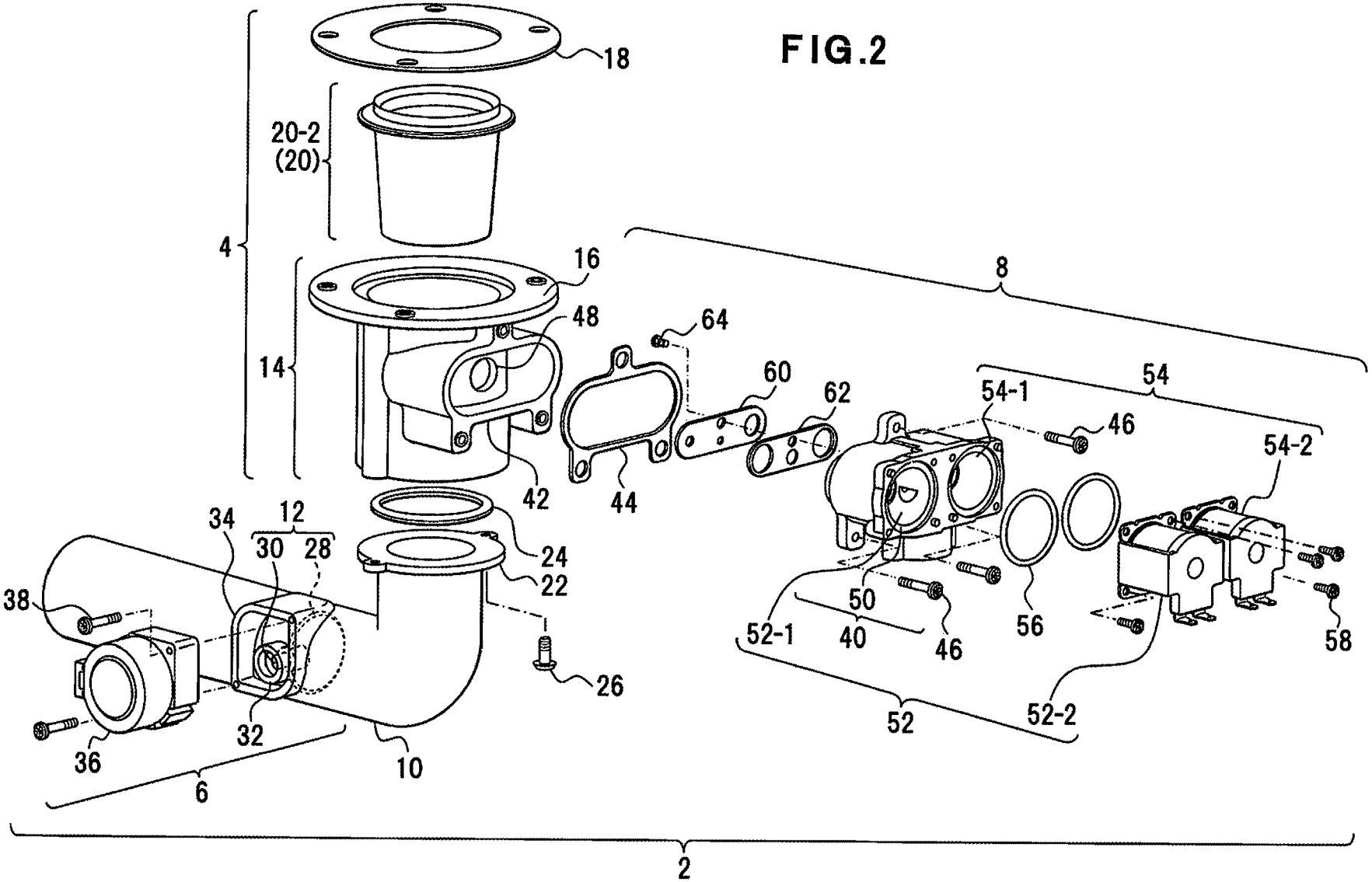
FIG. 2 is an exploded perspective diagram of a premixing apparatus according to Example 1.

FIG. 2 depicts an exploded state of the premixing apparatus 2 according to Example 1. In FIG. 2, the same parts as those in FIG. 1 are given the same reference numerals.

Venturi Unit 4

A housing 14 of the venturi unit 4 includes a flange unit 16 on the upper portion side thereof. A gasket 18 is sandwiched between the flange unit 16 and a combustion chamber member not depicted, and the housing 14 is attached to the combustion chamber member using screws not depicted. A second pipe path 20-2 is disposed on the housing 14, and the second pipe path 20-2 is consecutively disposed by a first pipe path 20-1 (FIG. 3) of a venturi pipe 20.

Air Supply Adjusting Unit 6

The air supply adjusting unit 6 is disposed on the cylinder unit 10 connected to the housing 14 on its upstream side. The cylinder unit 10 is a ventilating member that causes the air Ar to flow toward the venturi unit 4, is an example of a silencer, and includes a flange unit 22 on the upper end side thereof. A gasket 24 is sandwiched between the flange unit 22 and the housing 14, and the cylinder unit 10 is fixed to the housing 14 using plural fixing screws 26. The airtightness between the housing 14 and the cylinder unit 10 is maintained by the gasket 24 and the like. The terminal end of the cylinder unit 10 is open in the atmosphere.

The air supply adjusting unit 6 is provided for the cylinder unit 10 and includes the air adjusting valve 12. The air adjusting valve 12 includes a valve body 28 whose diameter is slightly smaller than the inner diameter of the cylinder unit 10, and the valve body 28 is provided with a rotational shaft 30. The rotational shaft 30 is rotatably supported by a bearing unit 32 of the cylinder unit 10 and the valve angle θ of the valve body 28 is therefore adjustable. The opening angle of the cylinder unit 10 is adjusted based on the valve angle θ and the load is thereby applied to the air Ar.

The cylinder unit 10 is provided with a motor attachment frame unit 34 that surrounds the bearing unit 32, and a step motor 36 is fixed to the motor attachment frame unit 34 by fixing screws 38. The step motor 36 is a driving means of the air adjusting valve 12 and rotation thereof is delivered to the valve body 28 through the rotational shaft 30 to enable the adjustment of the valve angle θ.

Gas Switching Unit 8

The gas switching unit 8 includes a gas switching block 40. The gas switching block 40 is fixed to a gas switching block attachment frame unit 42 of the housing 14 by fixing screws 46 across a gasket 44. The gas switching block 40 includes a gas path 50 that leads to a gas supply hole 48 on the side of the housing 14, and a first and a second gas switching valves 52 and 54 are disposed as examples of the opening and closing valve, on the gas path 50. The gas switching valve 52 includes a valve body 52-1 and a valve driving unit 52-2 that switch the path area of the gas path 50. The gas switching valve 54 includes a valve body 54-1 and a valve driving unit 54-2 that switch the path area of the gas path 50. The valve driving units 52-2 and 54-2 of the gas switching valves 52 and 54 are fixed to the gas switching block 40 by fixing screws 58 across a gasket 56.

An orifice member 60 is fixed to the front portion of the gas switching block 40 by a fixing screw 64 across a gasket 62. The orifice member 60 is an example of a switching plate used to switch the path area of the gas path 50.

Heat Source Apparatus 66

Figure 3:
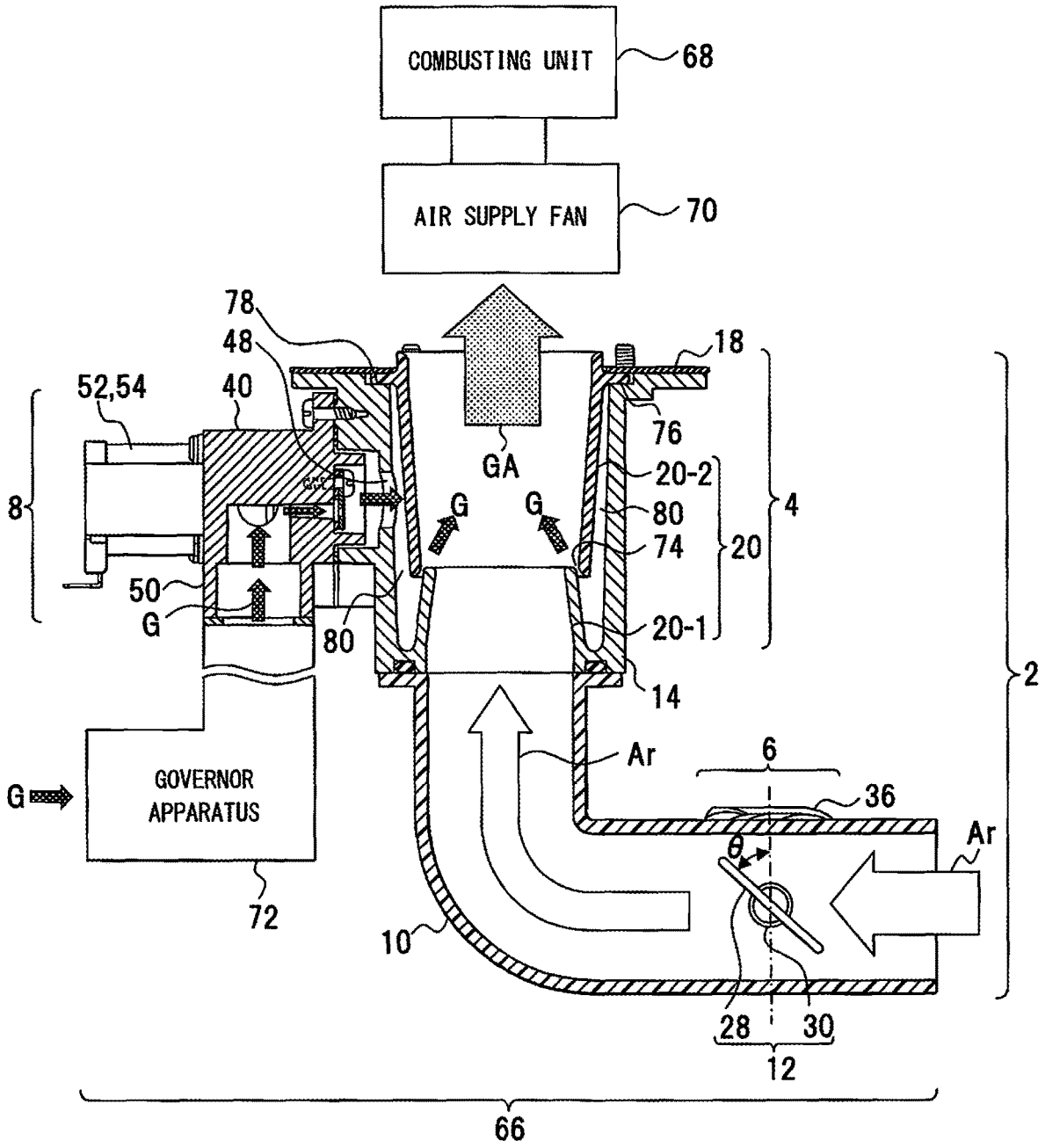
FIG. 3 is a diagram of a heat source apparatus that uses the premixing apparatus.

FIG. 3 depicts a heat source apparatus 66 that includes the premixing apparatus 2. In FIG. 3, the same parts as those in FIG. 2 are given the same reference numerals.

The heat source apparatus 66 includes a combusting unit 68, an air supply fan 70, a governor apparatus 72, and a premixing apparatus 2. The combusting unit 68 includes a combusting means such as a burner and combusts the air-fuel mixture GA. The air supply fan 70 is an example of a ventilating means that supplies the air-fuel mixture GA from the premixing apparatus 2 to the combusting unit 68, and generates the flow of the air Ar through the premixing apparatus 2. The governor apparatus 72 is connected to the gas path 50 of the gas switching block 40, is an example of a gas pressure adjusting means that adjusts the pressure of the fuel gas G such as the utility gas to a gas pressure equal to or substantially equal to the atmospheric pressure, and supplies the fuel gas G to the premixing apparatus 2 in response to a negative pressure action on the side of the premixing apparatus 2.

The premixing apparatus 2 includes, in the housing 14, a pipe path 20-1 of the venturi unit 4, and the pipe path 20-1 has a truncated cone-shaped air supply path formed therein whose inner diameter is set to be equal to the inner diameter of the cylinder unit 10 on the upstream side and is mildly reduced toward the downstream side. In contrast to the pipe path 20-1, a pipe path 20-2 is disposed on the downstream side of the housing 14 and forms a truncated cone-shaped mixing path. The inner diameter on the downstream side of this mixing path is formed to be larger than the diameter of the circumferential portion on the opening side of the pipe path 20-1, and the inner diameter of the mixing path is mildly increased from this inner diameter toward the opening on the downstream side. The pipe path 20-2 is put over the circumferential portion on the opening side of the pipe path 20-1 and a narrow path 74 to cause the fuel gas G to pass therethrough is formed between the circumferential portions on the opening sides of the pipe path 20-2 and the pipe path 20-1. A flange portion 76 is formed on the opening edge portion on the downstream side of the pipe path 20-2. The flange portion 76 is disposed on a step portion 78 on the side of the housing 14, and is sandwiched between the housing 14 and the gasket 18 to be fixed to a combustion chamber member not depicted together with the housing 14. The venturi pipe 20 is configured by the pipe path 20-2 and the pipe path 20-1 that are fixed to the housing 14. The back face side of the venturi pipe 20 is provided with a chamber 80, and the chamber 80 is filled with the fuel gas G supplied from the gas switching block 40.

When the air Ar flows from the upstream side of the cylinder unit 10 to the venturi pipe 20, the air Ar whose flow is reduced on the side of the pipe path 20-1 for its flow rate to be increased reaches the pipe path 20-2 and a negative pressure state is established on the side of the pipe path 20-2 from the Bernoulli's theorem. The fuel gas G on the side of the chamber 80 therefore passes through the narrow path 74 and is drawn into the pipe path 20-2 to be supplied to the overall circumference of the air Ar to be mixed with the air Ar. The air-fuel mixture GA is thereby produced and is guided from the pipe path 20-2 to the side of the combustion chamber not depicted.

Operation of Air Supply Adjusting Unit 6

Figure 4A:
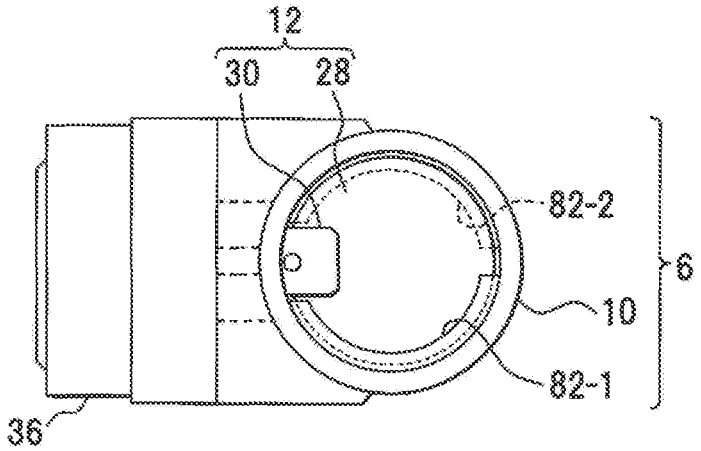
FIG. 4A is a diagram of an air adjusting valve.

As depicted in FIG. 4A, the valve body 28 of the air adjusting valve 12 is disposed in the cylinder unit 10 and the cylinder unit 10 includes valve seat units 82-1 and 82-2 that also act as stoppers to regulate the rotation range of the valve body 28, and the valve body 28 is sandwiched between the valve seat units 82-1 and 82-2. The valve body 28 rotates around the rotational shaft 30 in a range from θ1 [°] to θ3 [°] of the valve angle θ, can adjust the opening angle of the cylinder unit 10, and can apply a load to the air Ar.

Figure 4B:
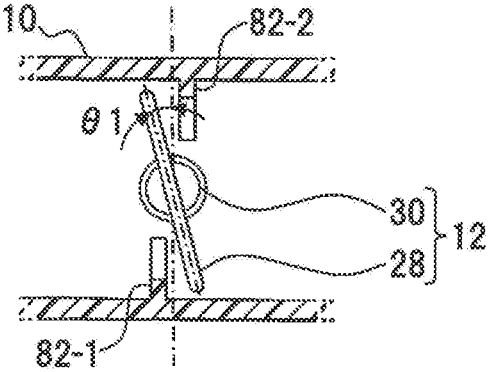
FIGS. 4B, 4C, and 4D are diagrams of a switching operation of a valve body.

As depicted in FIG. 4B, when the valve angle θ is θ1, the valve body 28 abuts the valve seat units 82-1 and 82-2, and the opening angle of the cylinder unit 10 becomes the minimal opening angle. The load on the air Ar therefore becomes the maximal load.

Figure 4C:
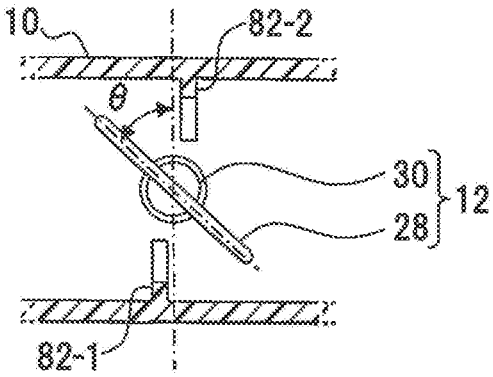

As depicted in FIG. 4C, when the valve angle θ is θ2, the opening angle of the cylinder unit 10 becomes the intermediate opening angle. The load on the air Ar therefore becomes the intermediate load.

Figure 4D:
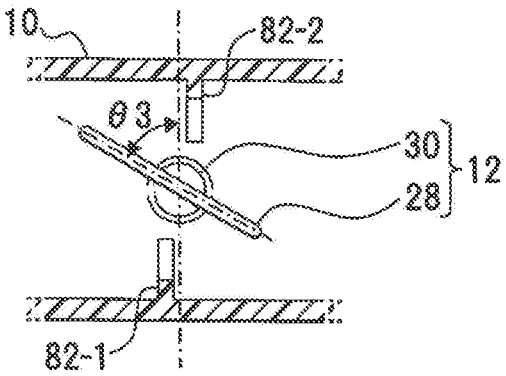

As depicted in FIG. 4D, when the valve angle θ is θ3, the opening angle of the cylinder unit 10 becomes the maximal opening angle. The load on the air Ar therefore becomes substantially no load.

Gas Switching Unit 8 and Function Thereof

Figure 5A:
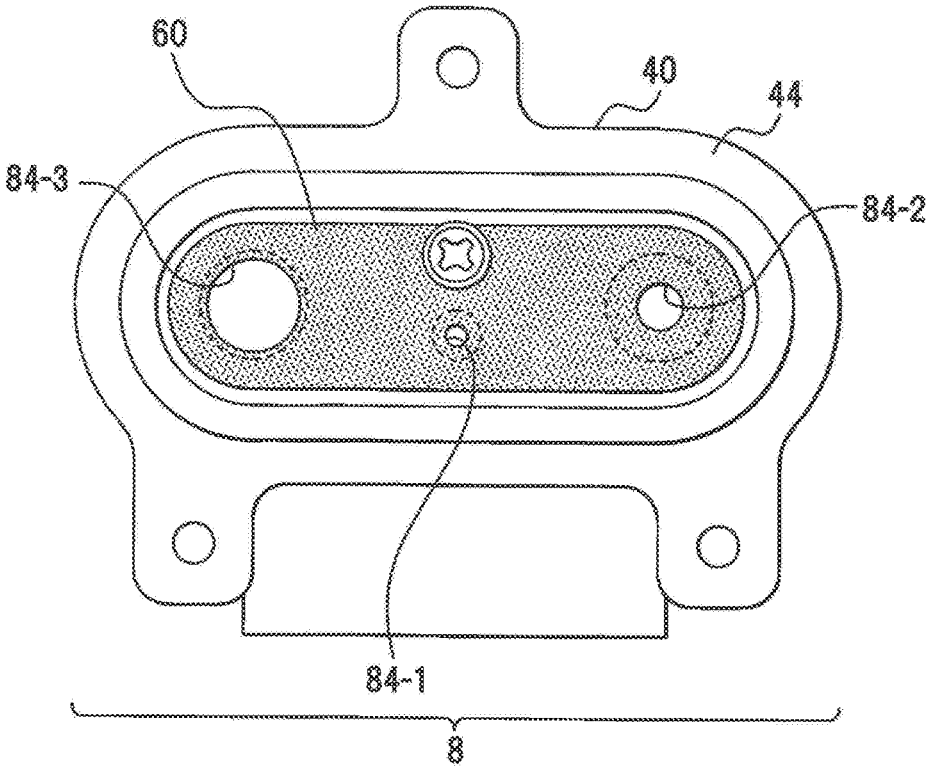
FIG. 5A is a diagram of the front side of a gas switching block.
Figure 5B:
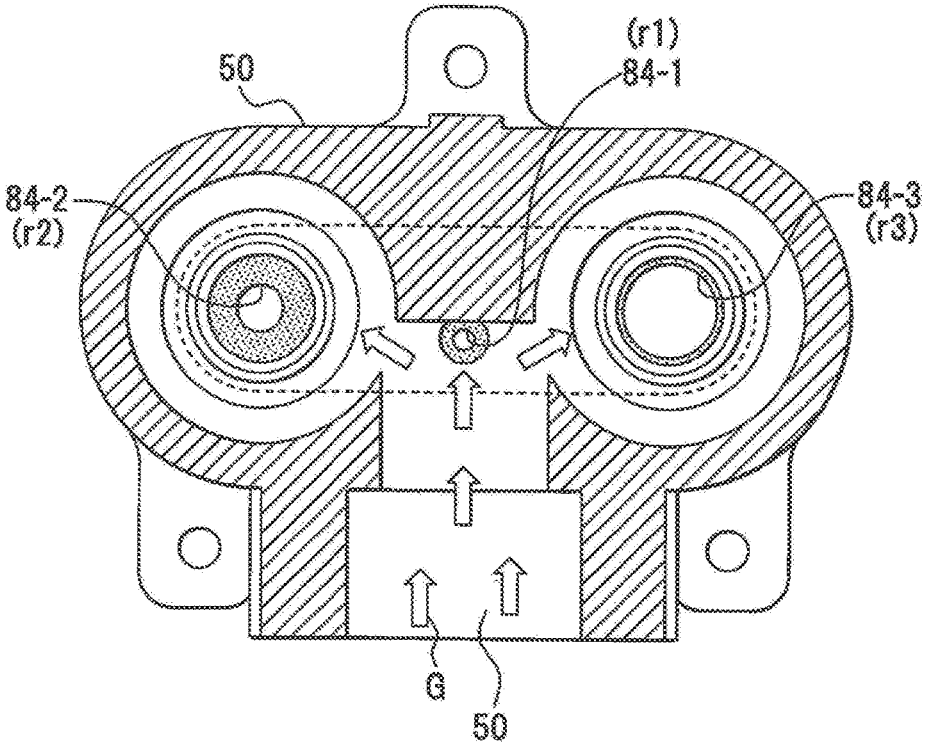
FIG. 5B is a cross-sectional diagram of the inside of the gas switching block.

As depicted in FIG. 5A, the orifice member 60 disposed in the front portion of the gas switching block 40 has a first, a second, and a third through holes 84-1, 84-2, and 84-3 formed therein. The through holes 84-1, 84-2, and 84-3 are examples of openings and, as depicted in FIG. 5B, communicate with the gas path 50. Representing the inner diameter of the through hole 84-1 as "r1", the inner diameter of the through hole 84-2 as "r2", and the inner diameter of the through hole 84-3 as "r3", these sizes are set to be in a relation: $r1<r2<r3$. The through hole 84-1 maintains normally opened condition. The through hole 84-2 is opened and closed by the gas switching valve 52 and the through hole 84-3 is opened and closed by the gas switching valve 54. The path area of the gas path 50 is thereby switched. Another orifice member 60 whose through holes 84-1, 84-2, and 84-3 have different diameters may be prepared and the orifice member 60 may be replaced in accordance with the gas type.

Figure 6A:
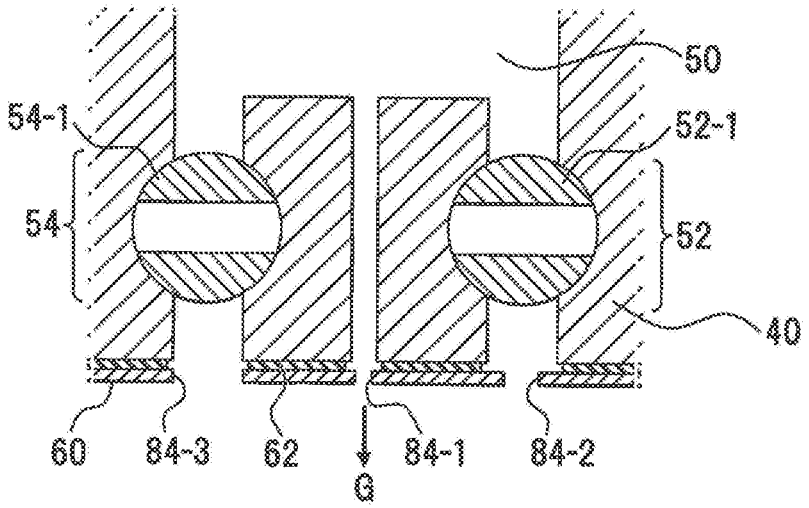
FIG. 6A is a diagram of the case where the gas switching valves of a gas switching mechanism of the gas switching block are closed.
Figure 6B:
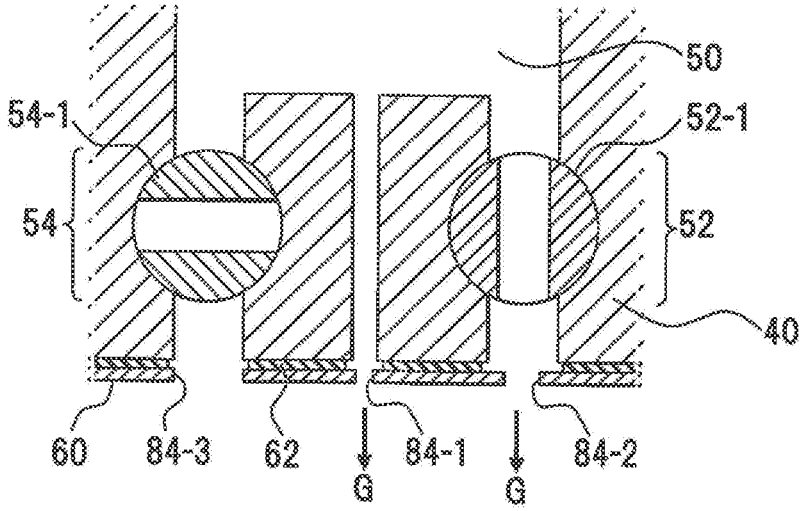
FIG. 6B is a diagram of the case where one gas switching valve is closed.
Figure 6C:
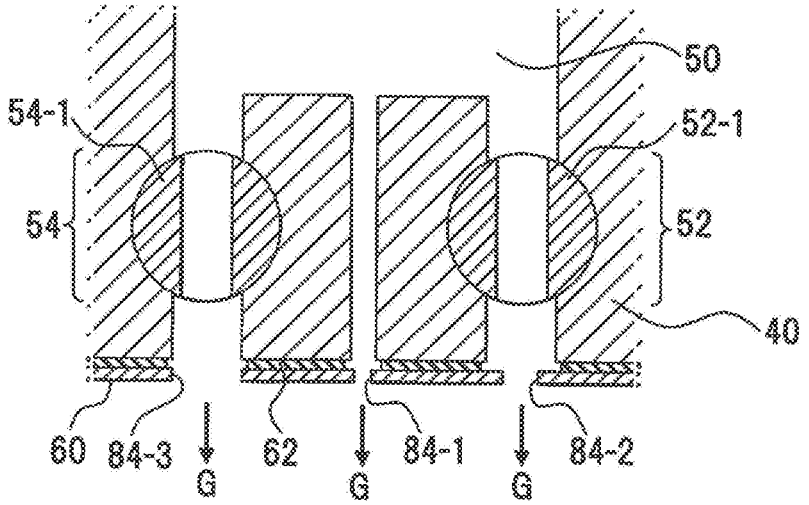
FIG. 6C is a diagram of the case where the gas switching valves are opened.

FIGS. 6A and 6B depict the gas switching mechanism of the gas switching block 40. FIG. 6A depicts the case where the gas switching valves 52 and 54 are closed. FIG. 6B depicts the case where the gas switching valve 52 is opened and the gas switching valve 54 is closed. FIG. 6C depicts the case where the gas switching valves 52 and 54 are opened.

a) In the case where the gas switching valves 52 and 54 are closed, only the through hole 84-1 is opened, the path area of the gas path 50 is minimal, and the gas amount of the fuel gas G supplied to the gas supply hole 48 is minimal.

b) In the case where the gas switching valve 52 is opened and the gas switching valve 54 is closed, the path area of the gas path 50 is secured by the through holes 84-1 and 84-2, and the gas amount of the fuel gas G supplied to the gas supply hole 48 is increased compared to that of a).

c) In the case where the gas switching valves 52 and 54 are opened, the path area of the gas path 50 is maximal by the through holes 84-1, 84-2, and 84-3, and the gas amount of the fuel gas G supplied to the gas supply hole 48 is maximal.

As above, the path area of the gas path 50 is switched in accordance with the selection of the opening or the closing of the gas switching valves 52 and 54, and the gas amount of the fuel gas G supplied from the gas supply hole 48 to the chamber 80 is therefore adjusted.

Governor Apparatus 72

A known air ratio governor can be used as the governor apparatus 72, and the governor apparatus 72 has a pressure adjustment function and a fuel gas supply function. The governor apparatus 72 receives the supply of the fuel gas G such as the utility gas, adjusts the pressure of the fuel gas G, and supplies the fuel gas G to the gas path 50.

Figure 7:
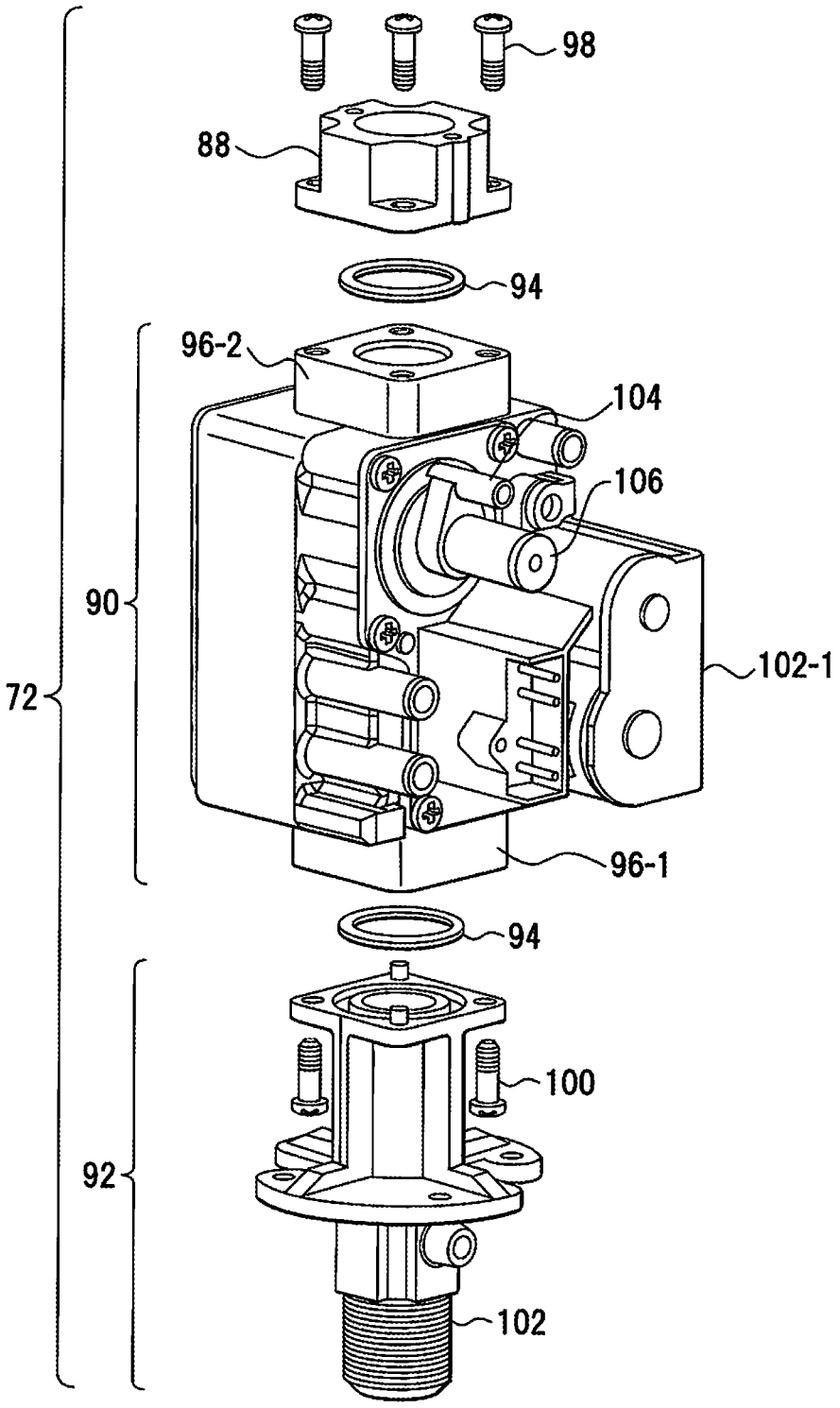
FIG. 7 is an exploded perspective diagram of a governor apparatus.

As depicted in FIG. 7, the governor apparatus 72 includes a connecting member 88, a governor main body 90, and a gas supplying member 92. The connecting member 88 is a member connecting the governor main body 90 to the gas switching unit 8 (FIG. 3), and is fixed to an exit side connecting unit 96-2 of the governor main body 90 by fixing screws 98 across an O-ring 94. The governor main body 90 is a functional unit that adjusts the pressure of the fuel gas G supplied from the gas supplying member 92 to equal to or substantially equal to the atmospheric pressure. The gas supplying member 92 is fixed to an entrance side connecting unit 96-1 of the governor main body 90 by fixing screws 100 across another O-ring 94, and a connecting unit 102 of the gas supplying member 92 is joined to a gas supply pipe not depicted to supply the fuel gas G.

Figure 8:
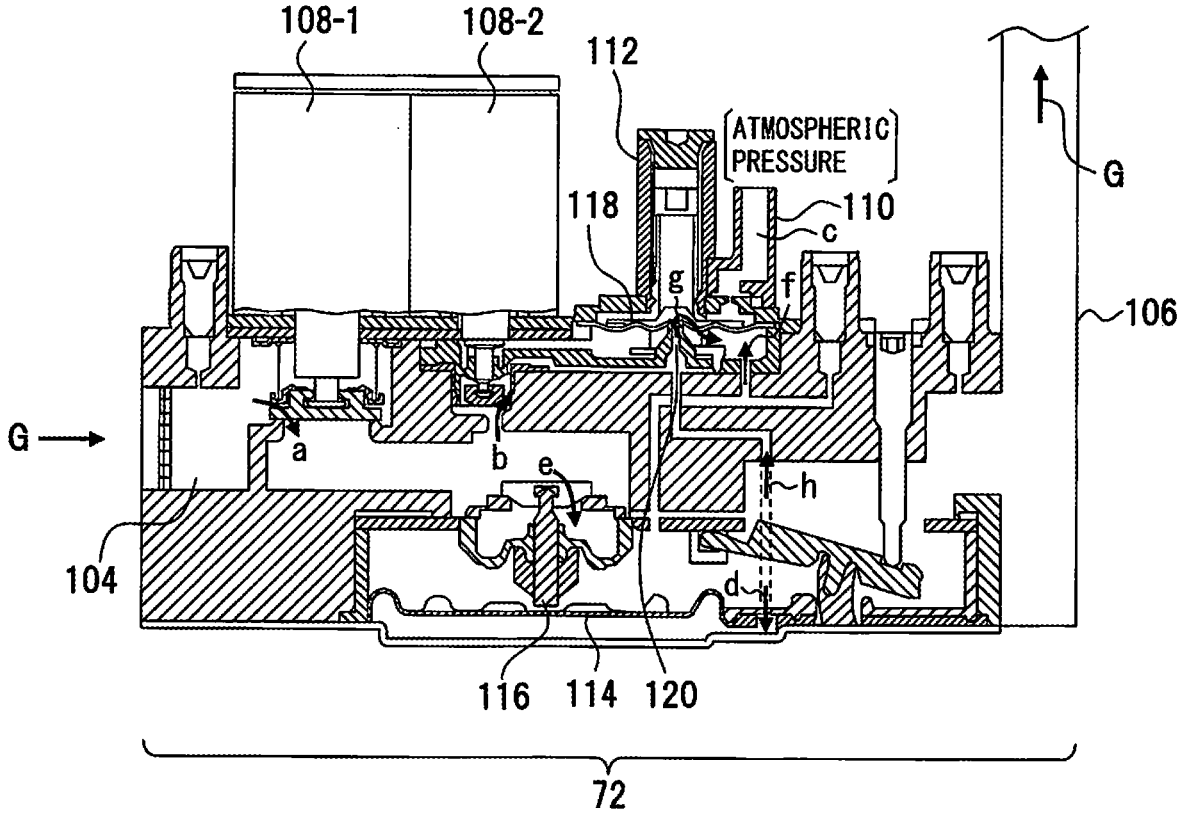
FIG. 8 is a diagram of the structure and an operation of the governor apparatus.

As depicted in FIG. 8, the governor apparatus 72 includes a gas path 104 and the gas path 50 is connected to the gas path 104 on its exit side by a pipe path 106. The gas path 104 is provided with a main valve 108-1 and an operation valve 108-2, and a back pressure pipe 110 is open in the atmosphere. The main valve 108-1 and the operation valve 108-2 are opened during application thereto of the power source. At this time, flows "a" and "b" are generated in the fuel gas G. A servo governor 112 receives the atmospheric pressure c to be closed and a flow d is generated. The pressure of the flow d acts on a main diaphragm 114 to set a main valve body 116 to be opened. A flow e is thereby generated, and the fuel gas G flows into the gas path 104 on the exit side thereof. A pressure f is generated together with the flow e and the fuel gas G flows into a diaphragm 118 on the lower side thereof of the servo governor 112. At this time, the diaphragm 118 is pushed up to a position to balance with the pressure of the air Ar acting on the gas path 50 (FIG. 3) by a pressure f pushing up the diaphragm 118. As a result, a servo valve body 120 is opened to generate a flow g to reduce the pressure of the flow d, and this pressure and the pressure f of the flow e are balanced with each other and are stabilized for a constant secondary pressure to be maintained. The fuel gas G whose pressure is adjusted to be the atmospheric pressure is acquired on the exit side of the gas path 104 and this fuel gas G flows into the gas path 50 through the pipe path 106.

As above, an exit pressure of the fuel gas G is basically the pressure of the back pressure pipe 110 in the air ratio governor configuring the governor apparatus 72, and the air ratio governor thereby operates to output a pressure equal to the back pressure of the servo diaphragm.

Control Unit 122

Figure 9:
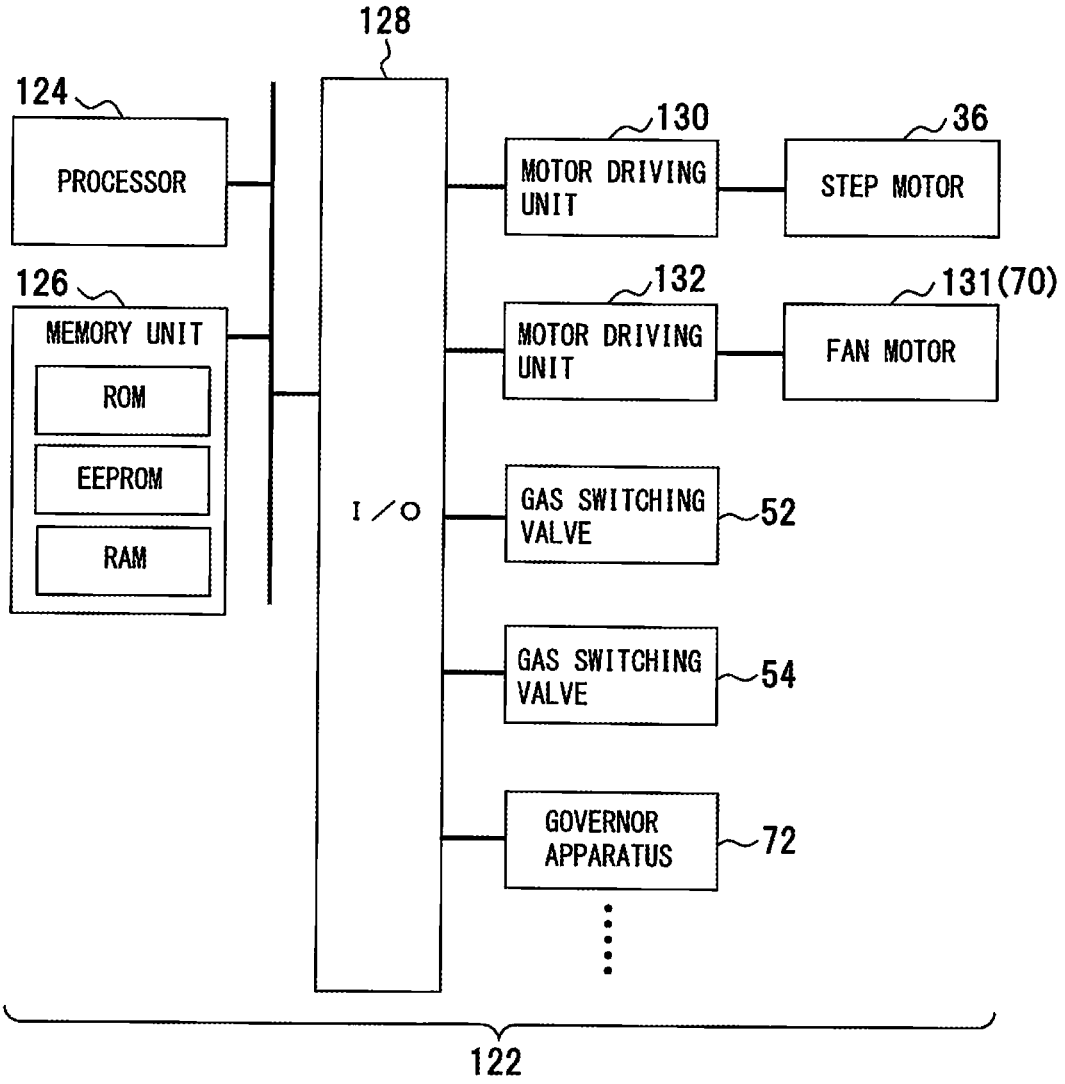
FIG. 9 is a diagram of an example of a control unit.

As depicted in FIG. 9, the heat source apparatus 66 includes a control unit 122 that includes a computer. The control unit 122 includes a processor 124, a memory unit 126, and an input/output unit (an I/O) 128.

The processor 124 executes an operating system (OS), a premixing program, and the like that are stored in the memory unit 126. The memory unit 126 has the OS, the premixing program, and the like stored therein, and includes a read-only memory (ROM), an electrically erasable programmable read-only memory (EEPROM), a random-access memory (RAM), or the like as a storing element.

The I/O 128 is connected to a motor driving unit 130 of the step motor 36, a motor driving unit 132 of a fan motor 131 of the air supply fan 70, and the gas switching valves 52 and 54. The rotation control of the air supply fan 70 or the step motor 36, and the selective switching of the gas switching valves 52 and 54 are executed through the I/O 128.

Formation of Air-Fuel Mixture GA

The operation of the air supply fan 70 is controlled by the control unit 122. The air Ar flows from the side of the cylinder unit 10 to the venturi unit 4 toward the combusting unit 68 by the operation of the air supply fan 70. The fuel gas G whose pressure is adjusted by the operation of the governor apparatus 72 to equal to or substantially equal to the atmospheric pressure is supplied to the chamber 80 of the venturi unit 4. The inside of each of the pipe paths 20-1 and 20-2 of the venturi unit 4 is set to be in the negative pressure state by the air Ar flowing through the venturi unit 4. In this case, the fuel gas G is drawn from the narrow path 74 into the venturi pipe 20 to be mixed with the air Ar and the air-fuel mixture GA is thereby formed. This air-fuel mixture GA is supplied to the combusting unit 68 through the air supply fan 70.

The angle of the valve body 28 of the air adjusting valve 12 of the air supply adjusting unit 6 is θ, the valve body 28 whose the angle is θ causes a load to act on the air Ar flowing from the cylinder unit 10 into the venturi unit 4, and the air amount necessary for forming the air-fuel mixture GA is thereby adjusted.

In contrast, the gas amount of the fuel gas G supplied to the venturi unit 4 is adjusted by the gas switching block 40. The fuel gas G flows from the governor apparatus 72 to the orifice member 60 side of the gas switching block 40. The through hole 84-1 is normally opened. In contrast, the through hole 84-2 is opened and closed by the gas switching valve 52 and the through hole 84-3 is opened and closed by the gas switching valve 54. The amount of the gas passing through the orifice member 60 is thereby adjusted.

The air-fuel mixture GA combusts in the combusting unit 68 and the gas consumption is in accordance with the air amount drawn into the air supply fan 70, that is, dependent on the number of rotations of the fan motor 131. For example, for a water heater (a water heater 134 depicted in FIG. 13), when the number of rotations of the fan motor 131 is set to be 2,000 to 6,000 [rpm], the gas consumption of 66,300 to 199,000 [BTU/h] is assumed. In this case, the turndown ratio is 1:3. When the number of rotations of the fan motor 131 is set to be the minimal number of rotations (2,000 [rpm]) and the air amount is adjusted by varying the angle θ of the valve body 28 of the air adjusting valve 12, an air amount can be acquired assuming, for example, 13,000 [BTU/h] as the minimal gas consumption. It is assumed, with the opening angle of the valve body 28, that the number of rotations of the fan motor 131 is a range from 2,000 to 6,000 [rpm], and that the gas consumption is 13,000 to 39,000 [BTU/h]. When the angle θ of the valve body 28 is varied, the gas consumption can therefore be adjusted to from the minimal gas consumption of 13,000 to the maximal gas consumption of 199,000 [BTU/h] and the turndown ratio of 1:15 is acquired.

The gas consumption can also be adjusted to from 13,000 to 199,000 [BTU/h] by varying the angle θ of the valve body 28 and the number of rotations of the fan motor 131 at the same time while both of the angle θ of the valve body 28 and the number of rotations of the fan motor 131 need to concurrently be controlled for linear control of the gas consumption from the minimal gas consumption to the maximal gas consumption and this control is cumbersome.

In contrast, within the range of the gas consumption acquired in the state where the angle θ of the valve body 28, which is fixed stepwise, is fixed, the gas consumption can be controlled by adjusting the number of rotations of the fan motor 131. When the angle of the valve body 28 is fixed, the controllable gas consumption is in a range from the gas consumption acquired when the number of rotations of the fan motor 131 is set to be its minimal number of rotations, to the gas consumption acquired when the number of rotations of the fan motor 131 is set to be its maximal number of rotations, and the ratio of the minimal number of rotations to the maximal number of rotations in this Example is 1:3. Assuming that the turndown ratio is 1:15, with the angle θ (=θ1) of the valve body 28 generating the minimal capacity, the gas consumption can be controlled within lower regions 1 to 3 of regions 1 to 15 by the turndown ratio conversion and, with the angle θ (=θ3) of the valve body 28 generating the maximal gas consumption, the gas consumption can be controlled within upper regions 5 to 15 by the turndown ratio conversion. In this case, the angle θ (=θ2) of the valve body 28 is provided to control the intermediate regions 2 to 6 by the turndown ratio conversion including overlapping regions to compensate the control of the gas consumption within the intermediate regions 3 to 5 by the turndown ratio conversion. When the turndown ratio is 1:15, the gas consumption can be controlled by the number of rotations of the fan motor 131 only by varying the angle θ of the valve body 28 among θ1, θ2, and θ3 (θ1<θ2<θ3).

Concerning the control of the air Ar executed when the turndown ratio of 1:15 is realized, the control of the supply of the gas is as follows.

In the case where the angle θ of the valve body 28 of the air adjusting valve 12 is each of θ1, θ2, and θ3, the mixing ratio of the air-fuel mixture GA can be adjusted to a predetermined value and the adjustment of the gas consumption of 13,000 to 199,000 [BTU/h] is enabled by the following gas amount adjustment of the fuel gas GA in three stages:

Only the through hole 84-1;

The through hole 84-1, and the through hole 84-2 with the gas switching valve 52 that is opened; and The through hole 84-1, and the through holes 84-2 and 84-3 with the gas switching valves 52 and 54 that are opened.

For example, when the through holes 84-2 and 84-3 are fully opened and the valve body 28 of the air adjusting valve 12 is set to be at the angle θ (=θ3) with which the maximal capacity is generated, the gas consumption of 99,000 [BTU/h] is acquired with the number of rotations of the fan motor 131 of 6,000 [rpm] and the gas consumption of 66,333 [BTU/h] is acquired with the number of rotation of the fan motor 131 of 2,000 [rpm]. This results in the turndown ratio of 5:15.

When the through holes 84-2 and 84-3 are fully closed and the valve body 28 of the air adjusting valve 12 is set to be at the angle θ (=θ1) with which the minimal capacity is generated, the gas consumption of 39,000 [BTU/h] is acquired with the number of rotations of the fan motor 131 of 6,000 [rpm] and the gas consumption of 13,000 [BTU/h] is acquired with the number of rotation of the fan motor 131 of 2,000 [rpm]. This results in the turndown ratio of 1:3.

With the above control, for the region having the gas consumption of 39,000 to 66,333 [BTU/h] and the turndown ratio of 3:5, the valve body 28 of the air adjusting valve 12 is adjusted for the angle θ to be θ2 and, as a result, an adjustment region having the turndown ratio of 2:6 and the gas consumption of 26,000 to 78,000 [BTU/h] is realized with the through hole 84-3 that is closed.

The inflow of the fuel gas G from the chamber 80 of the venturi unit 4 to the venturi pipe 20 depends on the number of rotations of the fan motor 131 based on the Bernoulli's theorem that the pressure of the air Ar becomes lower as the flow rate thereof becomes higher. In the venturi pipe 20, the flow rate of the air Ar is increased in a portion extending over the narrow path 74 into which the fuel gas G flows, to reduce the pressure in the venturi pipe 20. This pressure reduction is caused to act on the gas supply hole 48 side of the gas switching block 40 from the narrow path 74.

For the path area of the gas supply path between the gas supply hole 48 and the gas path 50 in the gas switching block 40, when the load on the air Ar is minimal, that is, the angle θ of the valve body 28 of the air adjusting valve 12 is set to be θ3, the inflow of the fuel gas G is set being matched with the state where the load on the air Ar is minimal. When a load is applied to the air Ar in the setting of the inflow of the fuel gas G matched with the state where the load on the air Ar is minimal, that is, for example, when the angle θ of the valve body 28 of the air adjusting valve 12 is set to be θ1, a gas amount of the fuel gas G more than necessary flows into the venturi pipe 20. In the opposite case, the supplied gas amount is insufficient. To avoid any excessive supply or any insufficient supply of the gas amount, the gas switching block 40 varies the supply path area. To adjust the supply amount of the fuel gas G according to the pattern of the load applied to the air Ar, the diameters of the through holes 84-1, 84-2, and 84-3 of the orifice member 60 disposed in the gas supply path are caused to differ from each other and the path area of the gas supply path is switched by opening or closing each of the through holes 84-2 and 84-3 by the gas switching valves 52 and 54.

In this case, in the setting of the path area of the same gas supply path, a process of adjusting the number of rotations of the fan motor 131 is employed on the premise of the function by the venturi pipe 20. The adjustment of the gas combustion amount using the path area of the same gas supply path is therefore executed using the adjustment of the number of rotations of the fan motor 131.

The three-stage switching of the angle θ of the valve body 28 of the air adjusting valve 12 and the switching of the path of the gas supply path are executed in this Example while the number of stages may be increased. The overlapping regions of the combustion amount in each stage may be increased by increasing the number of switching stages, or the variation amount of the number of rotations of the fan at switching the stages may be reduced by simplifying the control of the number of rotations of the fan from the maximum to the minimum number of rotations of the fan. When the switching of the paths of the gas supply path is increased, the switching patterns of the path area of the gas supply path may be increased. When the switching of the paths of the gas supply path is increased, for example, the gas switching block 40 may employ a switching method that uses a needle valve.

Number of Rotations of Air Supply Fan 70 and Air Amount

Figure 10:
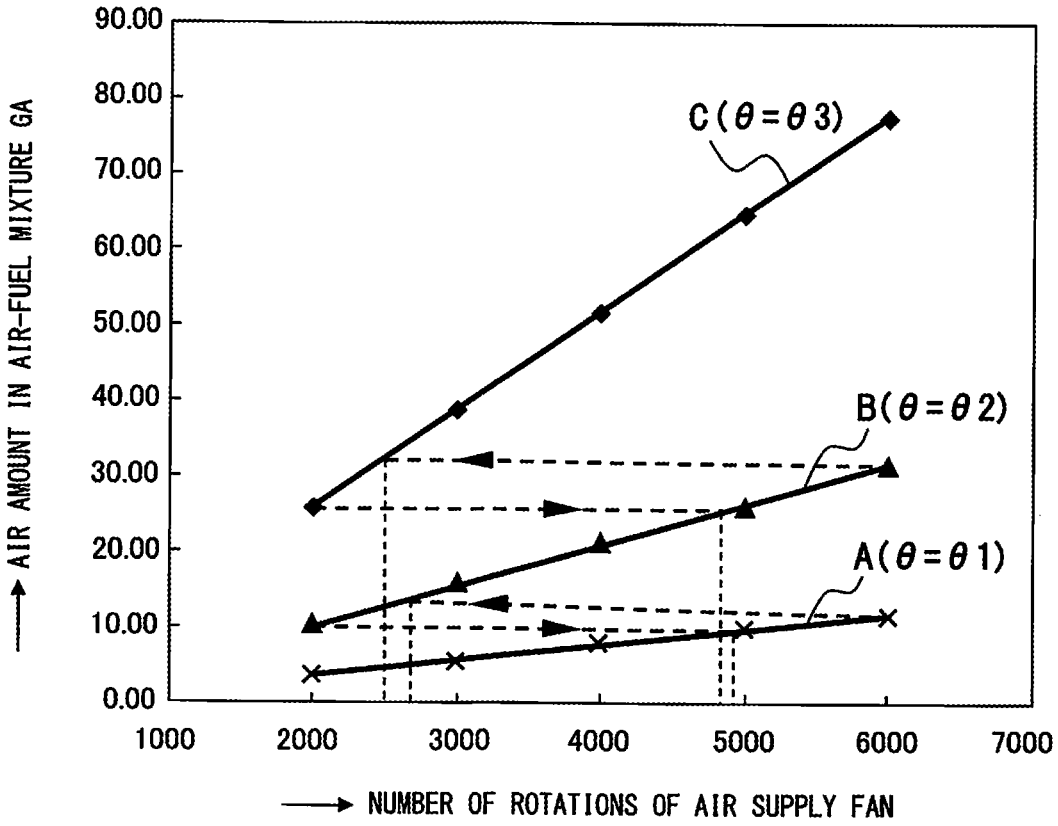
FIG. 10 is a graph of a relation between the number of rotations of an air supply fan and an air amount.

According to the premixing apparatus 2, as depicted in FIG. 10, the air amount can be adjusted in accordance with the number of rotations of the air supply fan 70.

When the valve angle θ of the valve body 28 of the air adjusting valve 12 is set to be θ1 and the number of rotations of the air supply fan 70 is continuously increased from the minimal number of rotations to the maximal number of rotations, the air of the amount in accordance with the increase or the reduction of the number of rotations of the air supply fan 70 flows through the venturi pipe 20 as indicated by A in FIG. 10.

When, from this state, the valve angle θ of the valve body 28 of the air adjusting valve 12 is switched to θ2 and the number of rotations of the air supply fan 70 is continuously increased from the minimal number of rotations to the maximal number of rotations, the air of the amount in accordance with the increase or the reduction of the number of rotations of the air supply fan 70 flows through the venturi pipe 20 as indicated by B in FIG. 10.

When, from this state, the valve angle θ of the valve body 28 of the air adjusting valve 12 is switched to θ3 and the number of rotations of the air supply fan 70 is continuously increased from the minimal number of rotations to the maximal number of rotations, the air of the amount in accordance with the increase or the reduction of the number of rotations of the air supply fan 70 flows through the venturi pipe 20 as indicated by C in FIG. 10.

The air amount can be controlled stepwise and continuously from the minimal air amount to the maximal air amount continuously as indicated by dotted lines for A, B, and C in FIG. 10 by switching the valve angle θ to θ1, θ2, or θ3 and increasing or reducing the number of rotations of the air supply fan 70. The dotted lines each having an arrow pointing the left each indicate the switching in the case where the air amount is increased, and the dotted lines each having an arrow pointing the right each indicate the switching in the case where the air amount is reduced.

Figure 11:
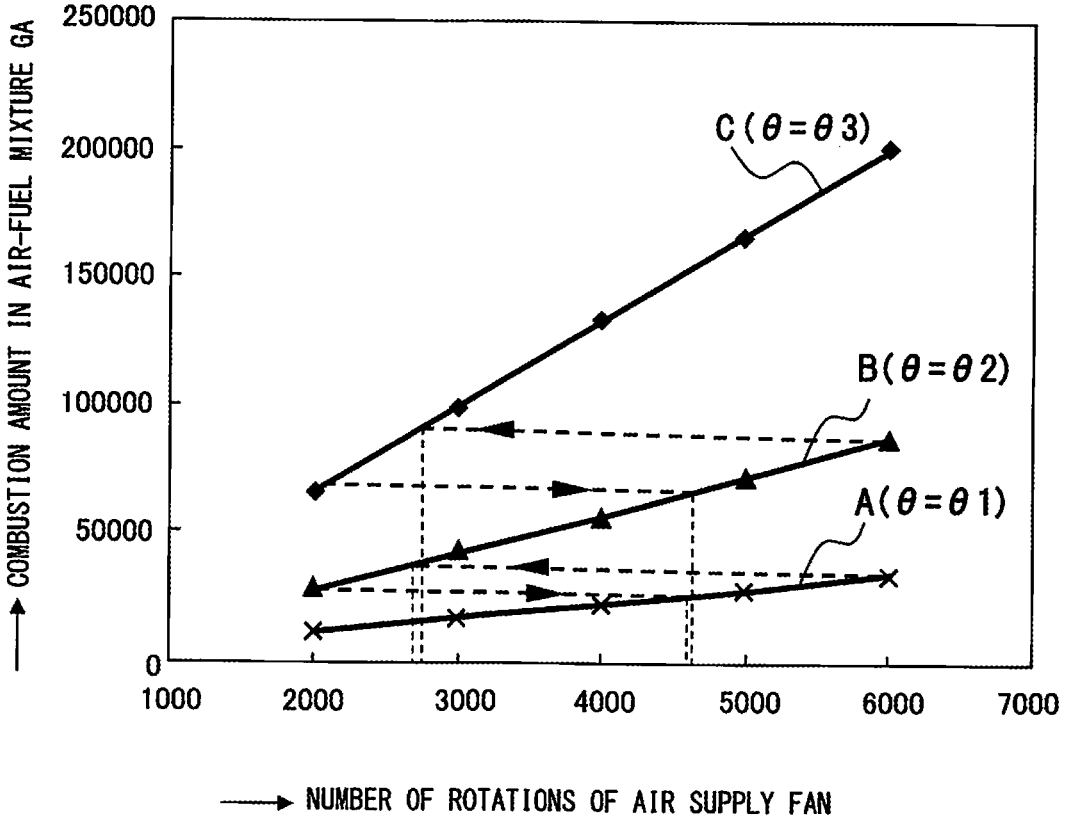
FIG. 11 is a graph of a relation between the number of rotations of the air supply fan and a combustion amount.

Number of Rotations of Air Supply Fan 70 and Combustion Amount of Air-Fuel Mixture GA According to the premixing apparatus 2, the combustion amount of the air-fuel mixture GA can be adjusted in accordance with the number of rotations of the air supply fan 70 as depicted in FIG. 11.

When the gas switching valves 52 and 54 are closed, the valve angle θ of the valve body 28 of the air adjusting valve 12 is set to be θ1, and the number of rotations of the air supply fan 70 is continuously increased from the minimal number of rotations to the maximal number of rotations, the air-fuel mixture GA is formed in accordance with the increase or the reduction of the number of rotations of the air supply fan 70 in the venturi pipe 20 as indicated by A in FIG. 11, and this is the combustion amount of the air-fuel mixture GA.

In this state, when the gas switching valve 52 is opened, the valve angle θ of the valve body 28 of the air adjusting valve 12 is set to be θ2, and the number of rotations of the air supply fan 70 is continuously increased from the minimal number of rotations to the maximal number of rotations, the air-fuel mixture GA is formed in accordance with the increase or the reduction of the number of rotations of the air supply fan 70 in the venturi pipe 20 as indicated by B in FIG. 11, and this is the combustion amount of the air-fuel mixture GA.

In this state, when the gas switching valves 52 and 54 are opened, the valve angle θ of the valve body 28 of the air adjusting valve 12 is set to be θ3, and the number of rotations of the air supply fan 70 is continuously increased from the minimal number of rotations to the maximal number of rotations, the air-fuel mixture GA is formed in accordance with the increase or the reduction of the number of rotations of the air supply fan 70 in the venturi pipe 20 as indicated by C in FIG. 11, and this is the combustion amount of the air-fuel mixture GA.

As above, the gas amount of the fuel gas G can be switched by switching the valve angle θ to θ1, θ2, or θ3 and selecting the closed state of the gas switching valves 52 and 54, the open state of only the gas switching valve 52, or the opened state of the gas switching valves 52 and 54 for the air amount in accordance with the number of rotations of the air supply fan 70, depicted in FIG. 10. The combustion amount of the air-fuel mixture GA can widely be adjusted stepwise and continuously from the minimal combustion amount to the maximal combustion amount as indicated by the dotted lines for A, B, and C in FIG. 11 because the air-fuel mixture GA in accordance with the increase or the reduction of the number of rotations of the air supply fan 70 is formed by switching the gas amount. The dotted lines each having the arrow pointing the left each indicate the switching in the case where the combustion amount is increased, and the dotted lines each having the arrow pointing the right each indicate the switching in the case where the combustion amount is reduced.

Supply Control of Air-Fuel Mixture GA

Figure 12:
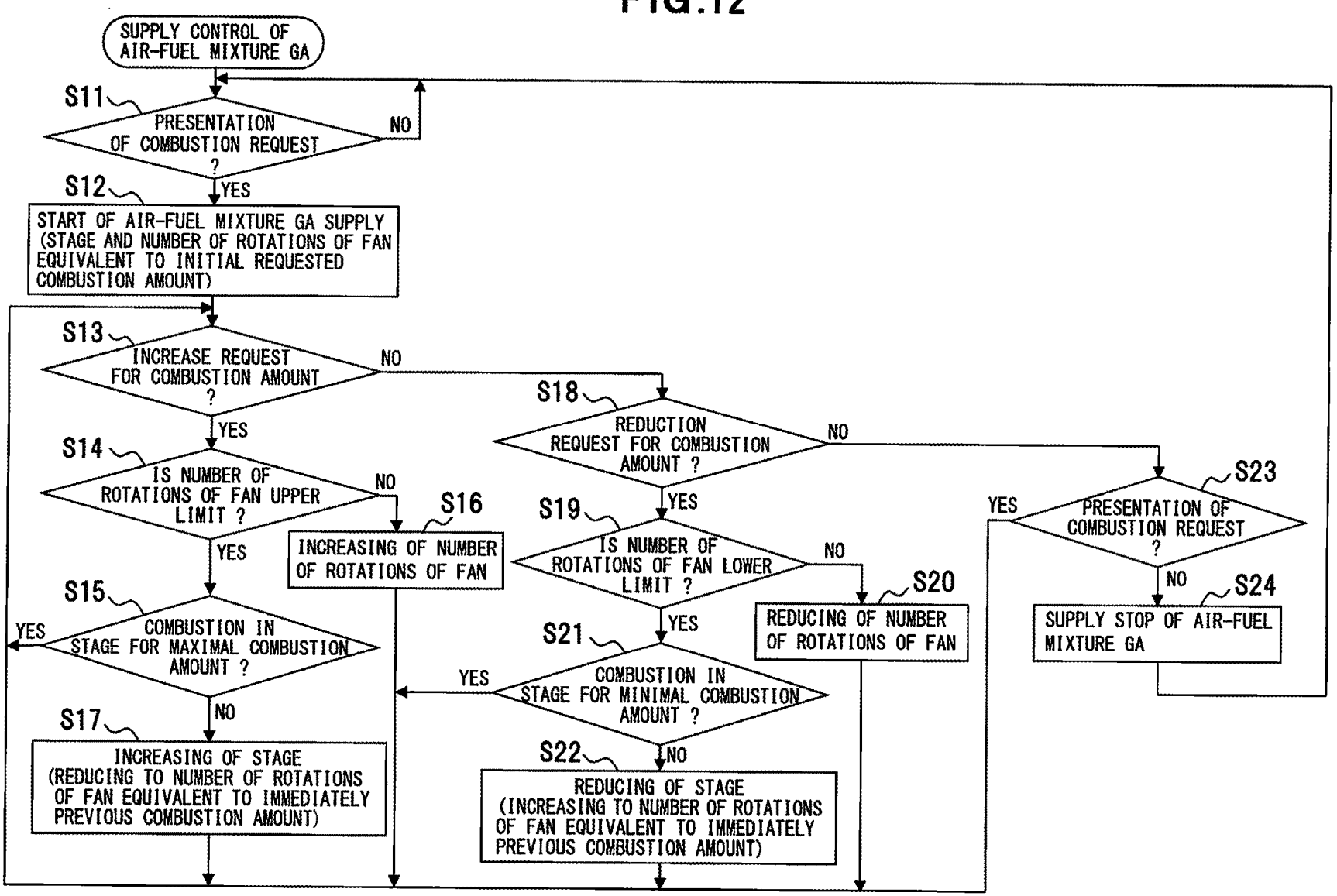
FIG. 12 is a flowchart of a process procedure for supply control of an air-fuel mixture.

FIG. 12 depicts a process procedure for the supply control of the air-fuel mixture GA in response to a combustion request.

In this process procedure, the control unit 122 determines whether any combustion request is present (S11). For example, when the combustion request for the burner occurs with the start of the hot water supply (YES of S11), the supply of the air-fuel mixture GA is started (S12). At this time, the control unit 122 determines any stage of A, B, or C, or the number of rotations of the air supply fan 70 from FIG. 11 based on the requested combustion amount.

The control unit 122 determines whether any increase request for the combustion amount is present during the combustion by the burner (S13). When an increase request for the combustion amount is present (YES of S13), the control unit 122 determines whether the number of rotations of the air supply fan 70 is at the upper limit (for example, 6,000 [rpm]) (S14). When the number of rotation of the fan is not at the upper limit (NO of S14), the control unit 122 causes the number of rotations of the air supply fan 70 to be increased (S16) and returns the process procedure to S13. When the number of rotation of the fan is at the upper limit (YES of S14), the control unit 122 determines whether the combustion is currently executed in the stage for the maximal combustion amount (S15). When the combustion is currently executed in the stage for the maximal combustion amount (YES of S15), the control unit 122 returns the process procedure to S13. When the combustion is not currently executed in the stage for the maximal combustion amount (NO of S15), the control unit 122 causes the stage to be increased (S17). In this case, the control unit 122 reduces the number of rotations of the fan to the number of rotations of the fan equivalent to the immediately previous combustion amount to execute the switching process indicated by the dotted line having the arrow pointing the left depicted in FIG. 11.

When no increase request for the combustion amount is present at S13 (NO of S13), the control unit 122 determines whether any reduction request for the combustion amount is present (S18). When a reduction request for the combustion amount is present (YES of S18), the control unit 122 determines whether the number of rotations of the air supply fan 70 is at the lower limit (for example, 2,000 [rpm]) (S19). When the number of rotations of the air supply fan 70 is not at the lower limit (NO of S19), the control unit 122 causes the number of rotations of the air supply fan 70 to be reduced (S20) and returns the process procedure to S13. When the number of rotations of the air supply fan 70 is at the lower limit (YES of S19), the control unit 122 determines whether the combustion is currently executed in the stage for the minimal combustion amount (S21). When the combustion is currently executed in the stage for the minimal combustion amount (YES of S21), the control unit 122 returns the process procedure to S13. When the combustion is not currently executed in the stage for the minimal combustion amount (NO of S21), the control unit 122 causes the stage to be reduced (S22). In this case, the control unit 122 increases the number of rotations of the fan to the number of rotations of the fan equivalent to the immediately previous combustion amount to execute the switching process indicated by the dotted line having the arrow pointing the right depicted in FIG. 11.

At S18, when no reduction request for the combustion amount is present (NO of S18), the control unit 122 determines whether any combustion request is present (S23). When a combustion request is present (YES of S23), the control unit 122 returns the process procedure to S13. When no combustion request is present (NO of S23), the control unit 122 stops the supply of the air-fuel mixture GA (S24) and returns the process procedure to S11. To stop the supply of the air-fuel mixture GA, the control unit 122 closes the switching valves 52 and 54, stops the air supply fan 70, and the like.

Effects of Example 1

According to Example 1, the following effects are achieved.

(1) The number of rotations of the air supply fan 70 and the load on the supplied air can each separately be controlled, and the adjustment of the gas amount is executed according to the adjustment of the number of rotations of the air supply fan 70 and the adjustment of the air amount using the load on the air supply. Consequently, the concurrent control of the number of rotations of the air supply fan 70 and the load on the air Ar can easily be executed for the supplied air.

(2) The load on the supplied air is fixed stepwise and, the adjustment is executed with this load using the number of rotations of the air supply fan 70. When an adjustment range is exceeded, the control to transition to the next stage can be executed, and the switching of the stage of the combustion amount of the air-fuel mixture GA combusted by the burner can be executed by the switching of the load on the air Ar and the switching of the gas amount by the gas switching unit 8. As a result, the turndown ratio acquired using the premixing apparatus 2 can be expanded up to 1:15 without degrading the mixing performance for the fuel gas G and the air Ar in contrast to the conventional turndown ratios of 1:3 to 1:4.

(3) The orifice member 60 is disposed in the gas switching unit 8 to adjust the gas amount drawn into the venturi unit 4, and is set so that the minimal gas amount is acquired with only the through hole 84-1 and the maximal gas amount is acquired when the through holes 84-2 and 84-3 are fully opened in addition to the through hole 84-1. The minimal gas amount is acquired when both of the gas switching valves 52 and 54 are closed, the maximal gas amount is acquired when both of the gas switching valves 52 and 54 are opened, and the gas amount can be adjusted between the minimal gas amount and the maximal gas amount by the selective opening and closing of each of the gas switching valves 52 and 54. For the air adjustment, the minimal air amount is set when the angle θ of the valve body 28 of the air adjusting valve 12 is θ1, the maximal air amount is set when the angle θ is θ3, and the intermediate air amount is set when the angle θ is θ2. The turndown can therefore be taken to be high without degrading the mixing performance for the fuel gas G and the air Ar.

Example 2

Figure 13:
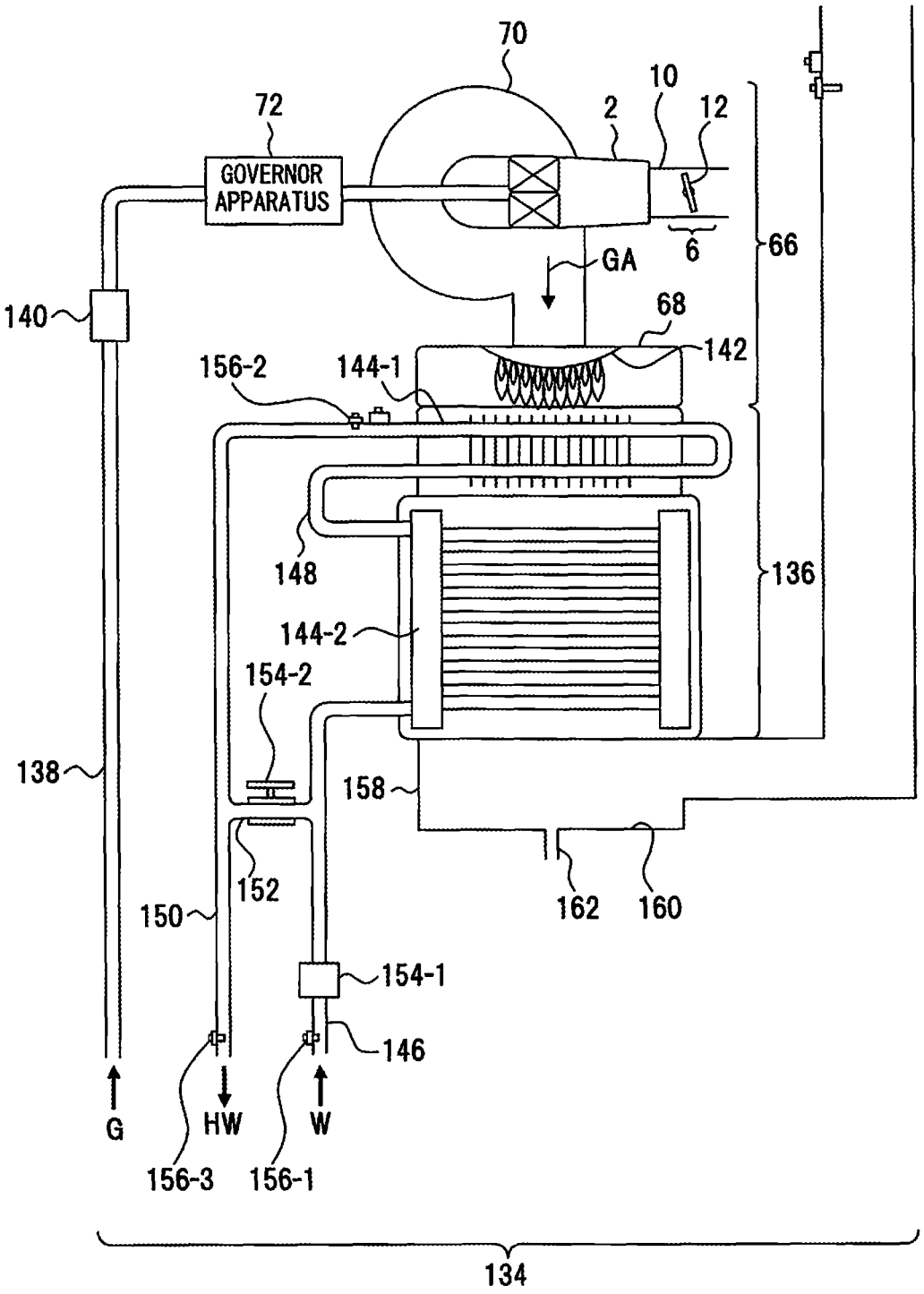
FIG. 13 is a diagram of a water heater according to Example 2.

FIG. 13 depicts a water heater 134 that includes the heat source apparatus 66. The same parts as those in FIG. 3 are given the same reference numerals.

The water heater 134 includes the heat source apparatus 66 and a heat exchanging unit 136. The fuel gas G is supplied through a gas supply pipe 138 to the heat source apparatus 66, and this fuel gas G is delivered to the premixing apparatus 2 through the governor apparatus 72. The gas supply pipe 138 is provided with an opening and closing valve 140 and this opening and closing valve 140 switches the fuel gas G between a supply state and a blocked state.

A burner 142 as a combusting means for the air-fuel mixture GA is disposed in the combusting unit 68. The burner 142 having a metal knit arranged in the combustion plane of the fuel gas G, that is, a what-is-called metal knit burner is used. In this example, the heat exchanging unit 136 is disposed on the lower side of the combusting unit 68 and the combustion plane of the burner 142 is therefore caused to face the heat exchanging unit 136 under the combusting unit 68. The air-fuel mixture GA is supplied to the burner 142 by the air supply fan 70.

A first heat exchanger 144-1 and a second heat exchanger 144-2 are disposed one above the other in the heat exchanging unit 136. The first heat exchanger 144-1 is a primary heat exchanger that heat-exchanges the sensible heat of the combustion exhaust generated by the burner combustion, and the second heat exchanger 144-2 is a secondary heat exchanger that heat-exchanges the latent heat of the combustion exhaust after the heat exchanging by the first heat exchanger 144-1.

Supplied water W flows into the inlet side of the heat exchanger 144-2 through a water supply pipe 146 during the hot water supply. Hot water HW produced by the heat changing by the heat exchanger 144-2 is introduced to the heat exchanger 144-1 through a jointing pipe portion 148. The hot water HW at a high temperature is acquired from the heat exchanger 144-1 and is taken out from a hot water supply pipe 150. A bypass pipe 152 is joined between the hot water supply pipe 150 and the water supply pipe 146.

The supplied water W flows into the water supply pipe 146 when a water supply valve 154-1 is opened, and the temperature of the supplied water W is detected by a temperature sensor 156-1. The temperature of hot water on the outlet side of the heat exchanger 144-1 is detected by a temperature sensor 156-2. The supplied water W can be mixed into the hot water HW when a bypass valve 154-2 of the bypass pipe 152 is opened. The temperature of the mixed water of the hot water HW and the supplied water W is detected by a temperature sensor 156-3. To control the temperature of the exiting hot water to be a set temperature, the opening angle of the bypass valve 154-2 is controlled in accordance with the temperature detected by the temperature sensor 156-3 that detects the temperature of the mixed water, and the mixing amount of the supplied water W to the hot water HW is thereby adjusted. The hot water at the set temperature can thereby be supplied.

A gas discharging unit 158 is disposed on the lower side of the heat exchanging unit 136 and the combustion exhaust after the heat exchanging can be discharged in the outer atmosphere through the gas discharging unit 158. The gas discharging unit 158 includes a drain receiving unit 160 and the drain produced by the heat exchanging by the heat exchangers 144-1 and 144-2 is accumulated in the drain receiving unit 160. The drain is discharged from a drain discharging hole 162 of the drain receiving unit 160.

Effects of Example 2

According to Example 2, the following effects are achieved.

(1) The water heater 134 uses the heat source apparatus 66 of Example 1 and the effects of the heat source apparatus 66 of Example 1 can therefore be achieved.

(2) With premixing apparatus using conventional venturi pipes, the turndown ratios thereof are limited by the adjustment spans of the number of rotations of air supply fans and the turndown ratio remains to about 1:3 to about 1:4 for a heating apparatus or a water heater where the usable number of rotations of an air supply fan is about 2,000 to about 7,000 [rpm]. In contrast, when the premixing apparatus 2 is used, the turndown ratio can further be expanded. Combustion control with a wide span can be realized.

Other Embodiments (1) In Example 1, the switching of the gas switching valves 52 and 54 on the gas switching block 40 is set to be the three-stage switching of the path area of the gas path 50 based on the fully closed state of the gas switching valves 52 and 54, the opened state of only the gas switching valve 52, and the fully opened state of the gas switching valves 52 and 54 while four-stage switching of the path area of the gas path 50 may be employed by adding the opened state of only the gas switching valve 54.

(2) In Example 2, the water heater 134 executing the hot water supply is exemplified while the present disclosure may be applied to a water heating and heating apparatus that has a heating function in addition to supplying hot water.

Aspects of the premixing apparatus, the heat source apparatus, and the water heater extracted from the embodiment and Examples are as follows.

According to an aspect of the premixing apparatus, the premixing apparatus includes the mixing unit that draws the fuel gas in the mixing unit by supplied air to mix the fuel gas and the supplied air with each other; the air supply adjusting unit that applies a load to the supplied air flowing toward the mixing unit and that switches the load; and the gas switching unit that switches the gas amount of the fuel gas to be supplied to the mixing unit.

In the premixing apparatus, the air supply adjusting unit may include the adjusting valve in the cylinder unit through which the supplied air flows, and may switch the load acting on the supplied air by varying the angle of the valve body of the adjusting valve.

In the premixing apparatus, the gas switching unit may include the gas switching plate that has the plural openings each causing the fuel gas to pass through the plural openings, opening diameter of the plural openings each being different from each other; the switching valve that opens and closes the one of the plural openings, and may switch the gas amount of the fuel gas passing through the plural openings by selective opening and closing of the one of the plural openings.

The premixing apparatus may further include the gas pressure adjusting means that adjusts the pressure of the fuel gas to be supplied to the gas switching unit to equal to or substantially equal to the atmospheric pressure.

According to an aspect of the heat source apparatus, the heat source apparatus includes the premixing apparatus; the combusting unit that combusts the air-fuel mixture formed by the premixing apparatus; and the air supply fan that supplies the air-fuel mixture from the premixing apparatus to the combusting unit.

According to an aspect of the water heater, the water heater includes the heat source apparatus and the heat exchanging unit that heat-exchanges the heat of the combustion exhaust generated in the combusting unit of the heat source apparatus with the supplied water to heat the supplied water.

According to the aspects of the premixing apparatus, the heat source apparatus, and the water heater, any of the following effects can be achieved.

(1) The load on the supplied air flowing toward the mixing unit is switched, the supplied air is increased or reduced for each load, and the supplied air is mixed with the fuel gas drawn into the mixing unit in accordance with supplied air. The air-fuel mixture can thereby be formed.

(2) Using this air-fuel mixture, the turndown ratio of the minimal combustion amount to the maximal combustion amount of the air-fuel mixture can be expanded to, for example, about 1:15.

(3) The switching of the supplied air and the switching of the supply amount of the fuel gas can each separately be executed by separately configuring each of the air supply adjusting unit and the gas switching unit of the fuel gas, for the mixing unit that forms the air-fuel mixture. The control of these can be facilitated, the adjustment structure can be simplified, and the premixing apparatus can be downsized.

(4) For the heat source apparatus and the water heater each using the premixing apparatus, the volume ratio of the premixing apparatus occupying in each of these apparatuses can be reduced and downsizing of the heat source apparatus and the water heater can be facilitated.

According to an aspect of the heat source apparatus, the turndown ratio of the minimal combustion amount to the maximal combustion amount of the air-fuel mixture can be expanded to, for example, about 1:15 and the adequate combustion can be realized in a range of these combustion amounts, and the use efficiency of the fuel gas can be increased.

According to an aspect of the water heater, the controllability of the temperature of the supplied hot water can be enhanced based on the turndown ratio of the minimal combustion amount to the maximal combustion amount, and comfortable hot water supply can be realized.

As above, the most preferred embodiment and the like of the present disclosure have been described. The present invention is not limited by the above description. Those skilled in the art can make various modifications and changes thereto based on the contents described in the appended claims or disclosed in the detailed description of the disclosure. Not to mention, such modifications and changes are encompassed in the scope of the present invention.

Using the premixing apparatus, the heat source apparatus, and the water heater of this disclosure, the turndown ratio of the minimal combustion amount to the maximal combustion amount of the air-fuel mixture can be expanded, and high quality gas combustion such as that excellent in the environmental property can be realized without degrading the mixing performance of the air-fuel mixture.

The invention claimed is:

1. A premixing apparatus comprising:

a mixing unit that draws a fuel gas in the mixing unit by supplied air to mix the fuel gas and the supplied air with each other;

a cylinder unit through which the supplied air flows;

an air supply adjusting unit that includes an adjusting valve having a valve body in the cylinder unit, an angle of the valve body being changed among first, second and third opening angles stepwise in at least three stages of the first, second, and third opening angles for the valve body to apply a load on the supplied air flowing toward the mixing unit, so that the load is switched by changing the angle of the valve body; and a gas switching unit that includes a gas supply path through which the fuel gas to be supplied to the mixing unit passes, and that switches a path area of the gas supply path stepwise in at least three stages in accordance with the first, second, or third angle of the valve body changed stepwise.

2. The premixing apparatus according to claim 1, wherein the gas switching unit further includes:

a gas switching plate that has plural openings each causing the fuel gas to pass through the plural openings, opening diameters of the plural openings each being different from each other; and a switching valve that opens or closes one of the plural openings, wherein the gas switching unit switches the path area of the gas supply path by selective opening or closing of the one of the plural openings.

3. A heat source apparatus comprising:

the premixing apparatus according to claim 1; and a control unit that includes a processor, changes the angle of the valve body and switches the path area of the gas supply path in accordance with the angle of the valve body.

4. The heat source apparatus according to claim 3, further comprising an air supply fan that supplies the supplied air to the mixing unit, wherein the control unit adjusts an amount of the supplied air supplied by the air supply fan in each of the first, second, and third opening angles and in a state where the angle of the valve body and the path area of the gas supply path are fixed.

5. The heat source apparatus according to claim 3, wherein the gas switching unit further includes:

a gas switching plate that has plural openings each causing the fuel gas to pass through the plural openings, opening diameters of the plural openings each being different from each other; and a switching valve that opens or closes one of the plural openings, wherein the control unit opens or closes the switching valve to switch the path area of the gas supply path by selective opening or closing of the one of the plural openings.

6. The heat source apparatus according to claim 3, further comprises a combusting unit, wherein the air supply fan supplies the air-fuel mixture from the premixing apparatus to the combusting unit, and the combusting unit combusts the supplied air-fuel mixture.

7. A water heater comprising:

the heat source apparatus according to claim 6; and a heat exchanging unit that heat-exchanges heat of a combustion exhaust generated in the combusting unit of the heat source apparatus with supplied water to heat the supplied water.

* * * * *